United States Patent [19]

Vedenpä et al.

[11] 4,416,070

[45] Nov. 22, 1983

[54] AIR-DIRECTING DEVICE FOR MULTIPLE CYLINDER DRYER OF PAPER MACHINE

[75] Inventors: Timo Vedenpä, Jyväskylä; Yngve Lindström; Pekka Eskelinen, both of Turku; Jorma Kotanen, Jyväskylä, all of Finland

[73] Assignee: Valmet Oy, Finland

[21] Appl. No.: 324,861

[22] Filed: Nov. 24, 1981

[30] Foreign Application Priority Data

Dec. 1, 1980 [FI] Finland ..... 803721

[51] Int. Cl.[3] ..... F26B 13/08

[52] U.S. Cl. ..... 34/114; 34/116; 34/117

[58] Field of Search ..... 34/114, 116, 117, 120, 34/122, 123; 162/207, 290; 285/13, 282; 239/518, 521

[56] References Cited

U.S. PATENT DOCUMENTS

| | | | |
|---|---|---|---|
| 992,688 | 5/1911 | Pope | 34/114 |
| 1,438,211 | 12/1922 | Baetz | 34/114 |
| 1,536,230 | 5/1925 | McCue | 239/521 |
| 1,595,478 | 8/1926 | Minton | 34/117 |
| 2,931,107 | 4/1960 | Sellers | 34/114 |
| 3,250,019 | 5/1966 | Beachler | 34/117 |
| 3,358,384 | 12/1967 | Gustafsson et al. | 34/114 |
| 3,908,368 | 9/1975 | Witt | 285/331 |

*Primary Examiner*—Larry I. Schwartz
*Assistant Examiner*—David W. Westphal
*Attorney, Agent, or Firm*—Steinberg & Raskin

[57] ABSTRACT

An air-directing device for directing air to the multiple cylinder dryer of a paper machine includes members for blowing dry air into the vicinity of the web at those points where the evaporation of water from the web is strongest. This reduces the humidity in such regions and promotes the evaporation of water from the web. The points are the initial parts of the cylinder intervals after contact with the web. The air-directing device is so placed, and its air-blowing members are so disposed and directed, that the air blown out from such members is directed into the clefts defined by the surface of the drying cylinder and the paper web. This achieves a pressure effect in the clefts. The air-blowing members are primarily used in connection with single fabric conduction in pockets on the side of the web to urge the web fast to the fabric and are preferably disposed on a doctor beam or in conjunction therewith.

2 Claims, 9 Drawing Figures

AIR-DIRECTING DEVICE FOR MULTIPLE CYLINDER DRYER OF PAPER MACHINE

BACKGROUND OF THE INVENTION

The present invention relates to a multiple cylinder dryer of a paper machine. More particularly, the invention relates to an air-directing device for a multiple cylinder dryer of a paper machine, which device introduces air to the dryer and includes air-blowing members.

Regarding the technology associated with the invention, reference is made to SE patent No. 67,305, SE patent No. 321,408, CA patent No. 810,896, U.S. Pat. No. 3,283,415, British Pat. No. 927,564 and FI patent No. 45,884.

The present invention touches on the procedure in a multiple cylinder dryer disclosed in Finnish patent application No. 803,720 of the inventor which issued as Finnish Pat. No. 62,693 on Feb. 10, 1983, wherein the dryer comprises a number of heatable cylinders and potentially equivalent rollers. A drying fabric is used in the dryer in support of which drying fabric a web goes from one cylinder and/or roller to another in closed conduction. The cyclic travel of the fabric is so arranged that part of the drying cylinders and/or rollers remain within the loop of the fabric and part thereof outside the loop. One or more supporting fabrics are used in the dryer to carry the web on the cylinders and/or rollers. The supporting fabric are guided by guide rollers. In the dryer, elongated pockets are defined in conjunction with the cylinders by the web runs supported by the drying fabric, by the free surfaces of the drying cylinders and by the runs of the supporting fabric.

The aforedescribed procedure disclosed in said Finnish patent application is mainly characterized in that of the aforementioned pockets in which the web resides on that side of the fabric which faces the pocket have been rendered under atmospheric pressure, at least in the initial part of the dryer, as viewed in the direction of travel of the web, and under a pressure higher than in the adjacent pockets, so that the differential pressure in question will urge the web against the felt with a view to stabilizing the running of the web.

It is known in the art to utilize various types of air conditioning apparatus, blow tubes, etc. in the drying section of a paper machine. These have been used in connection with twin-wire conduction for regulating the humidity of air in the pockets. They influence the pressure level in certain instances, but since this influence is not directional in any way, and since the pressure level is the same in the pockets on both sides of the web, it has not been possible thereby to effect the behavior of the web. As known in the art, more modern apparatus of this type have been located on the non-paper side of the felts, and the older apparatus, when actual felts are used, have been located on the paper side of the fabric or at the ends of the pockets.

In connection with single felt conduction, as known in the art, no actual pocket ventilating devices have been used, as a rule. Replacement air has in some instances been introduced from below the single felt conduction drying section by header beams extending across the machine and usually disposed in the interstices of the transversal structural beams of the building. The structural designs have recently been altered in such a way that the beams are completely omitted. For this reason, separate air introduction tubes are no longer permitted under a single felt drying section. Such tubes might break in the event of a web break. It has not been possible by this procedure to promote web stability.

Blowing from the side in, under the machine, has been utilized in connection with single felt conduction for the purpose of supplying replacement air. The pressure level and the behavior of the web, in the sense implied in the invention, could not be influenced by this expedient, either. On the contrary, this procedure of the prior art has caused instability of the web, particularly in the marginal part.

Although the air-directing device of the invention is primarily intended to be used in connection with single felt conduction, it is appropriate for use more universally.

SUMMARY OF THE INVENTION

The principal object of the invention is to provide an air-directing device for a multiple cylinder dryer of a paper machine, which device serves as introduction passages for air absolutely required in view of the air flow balance in the region in question, which passages direct dry air to the vicinity of the web, at these points where the evaporation of water from the web is strongest, whereby the humidity in the region may be reduced, thereby promoting the evaporation of water from the web.

An object of the invention is to provide an air-directing device for a multiple cylinder dryer of a paper machine, which device directs dry air to points which are the initial parts of the cylinder intervals after contact with the web.

Another object of the invention is to provide an air-directing device for a multiple cylinder dryer of a paper machine, which device functions economically, efficiently, effectively and reliably to direct air into the clefts defined by the surface of the drying cylinder and the paper web.

In order to attain these objects, and others which will become apparent hereinafter, in accordance with the invention, the air-directing device is so placed, and its air-blowing members are so disposed and directed, that the air blown out from such members is directed into the clefts defined by the surface of the drying cylinder and the paper web and achieves a pressure effect in the clefts.

BRIEF DESCRIPTION OF THE DRAWINGS

For a fuller understanding of the invention, reference is had to the following description, taken in connection with the accompanying drawings, in which.

DESCRIPTION OF PREFERRED EMBODIMENTS

Figure 1:
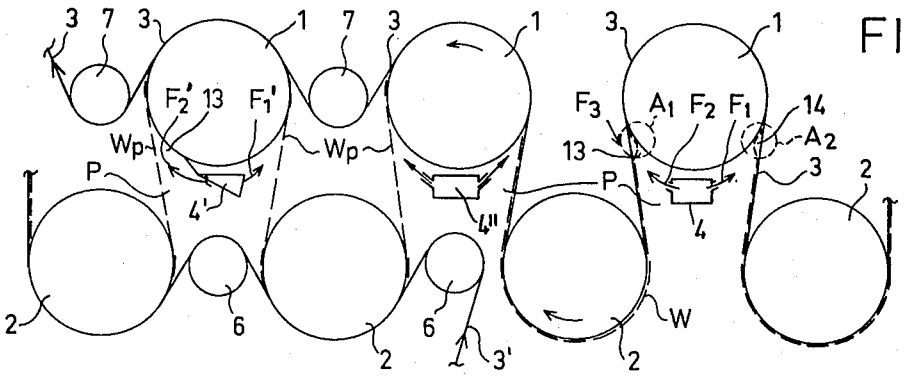
FIG. 1 is a schematic diagram of a multiple cylinder dryer of a paper machine, showing the placing of the air-directing devices of the invention.

The multiple cylinder dryer depicted in FIG. 1 comprises two rows of drying cylinders one above the other. These consist of a row of upper cylinders 1 and a row of lower cylinders 2. Single felt conduction is implemented in the initial part of the group of cylinders 1 and 2, using a drying fabric 3, such as, for example, felt, in support of which the paper web W runs in zigzag fashion from one row of cylinders to the other. The path of the drying fabric 3 changes under the guidance of guide rollers 7 after the second cylinder in the upper row, so that the web has free draws $W_P$ between the cylinders 1 and 2. Guide rollers 6 are provided in the interstices of the lower cylinders 2. A supporting fabric 3', which carries the web W on the cylinders 2, passes over said guide rollers. A similar supporting fabric may also be provided in conjunction with the first cylinders 1.

Beams 4, 4' and 4'' are provided in conjunction with the free surfaces of the upper cylinders 1. The beam 4' simultaneously serves as a frame for the doctor blade. In accordance with the invention, the box-type beams 4, 4' and 4'' are used as headers to conduct and direct air into pockets P and into clefts 13 and 14, or cleft 13.

FIG. 1 shows three alternative placements of the air-blowing members or beams 4, 4' and 4'' of the invention, as well as the preferred blowing directions $F_1$ and $F_2$ of said members. In twin felt conduction, the velocities of the air blown in the directions $F_1$ and $F_2$ should be kept comparatively low. The desired air flow must be produced primarily by a wide flow cross-sectional area. In single felt conduction, by contrast, considerable over-pressures and differential pressures with reference to the ambient atmospheric pressure $P_o$ may be achieved.

In FIG. 1, the air flow $F_2$ induced by the felt 3 at $A_1$ tends to pass through said felt. Sub-atmospheric pressure is in the cleft 13 on the side where the web W is. Due to the combined effect of the air flow and the sub-atmospheric pressure, the web W tends to separate from the felt 3, whereby the support action of said felt stabilizing said web and reducing the web breaks would be lost. On the other hand, the small air quantities which are captured in the cleft 14 between the web W and the felt 3 cause an over-pressure in said cleft. If this over-pressure does not have time to discharge through the felt 3, a bulge is formed in the web W in the cleft 14, as shown by broken lines in FIG. 1, and this causes wrinkles in said web and even web breaks.

As hereinbefore mentioned, no influence could be exerted on the aforedescribed phenomena by the known or traditional procedures, because even when potentially affecting the pressure level, these methods merely raise the pressure level on the whole. This produces no differential pressure across the web, which is the object of the invention, achieved by directing to critical points the pressure effect produced by a pulse of air flow.

In trial machine experiments carried out by the inventor, pressures up to 550 Pa have been measured, under operating conditions of air blown in the directions $F_1$ and $F_2$ at the sides of the web W. In the absence of extra equipment, there is a sub-atmospheric pressure of about 10 to 20 Pa at the side of the web W in the region $A_1$. Correspondingly, there is a slight over-pressure in the region $A_2$, depending on the machine speed. Measurements performed by the inventor in actual practice, on production machines, indicate that substantially lower differential pressures have a significant effect on the behavior of the web W in the critical regions discussed.

The air-blowing operations of the air-directing device of the invention thus make it easy to produce an over-pressure which cancels the pressures tending to detach the web W from the felt 3, on the side of said web.

Figure 2:
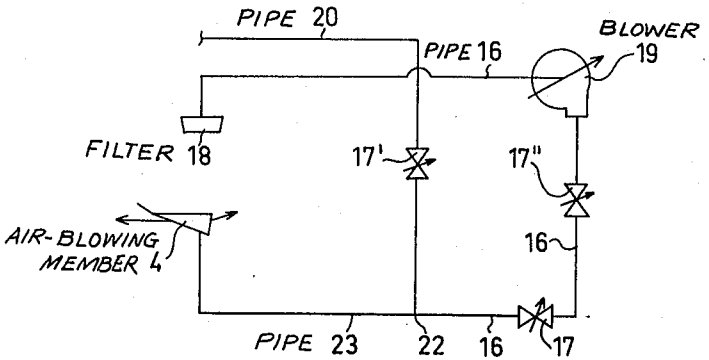
FIG. 2 is a schematic diagram of an embodiment of an air circuit system for the air-directing device of the invention.

FIG. 2 shows a system for connecting a doctor blade in accordance with the invention, which enables volumetric flows to be used for blowing air which exceed the replacement air quantity consistent with the air flow balance. In FIG. 2, a pipe 20 communicates with the network supplying the pocket ventilation and/or replacement air (not shown in the FIGS.). The flow to the air-blowing members 4, 4' and 4'' is controlled by a valve 17'. A pipe system 16 begins inside the hood at a filter 18 and continues to a blower 19, which may be a controllable output blower. The pipe system 16 continues from the blower 19 through control valves 17'' and 17 to a branch point 22, whence it continues as a single pipe 23 to the air-blowing members 4, 4' and 4''.

Figure 3:
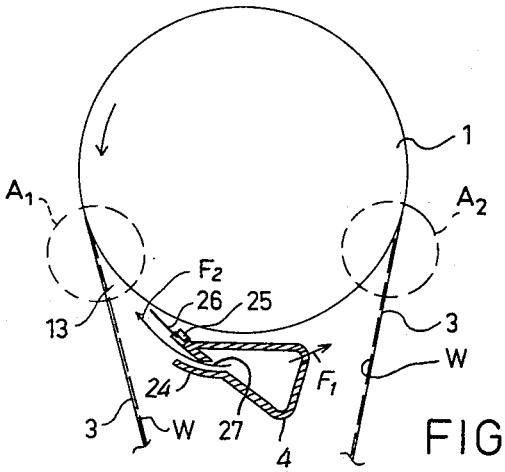
FIG. 3 is a sectional view, on an enlarged scale, of an embodiment of the air-directing device and a first embodiment of the air-blowing member of the invention, showing the placing thereof in a multiple cylinder dryer of a paper machine.
Figure 3A:
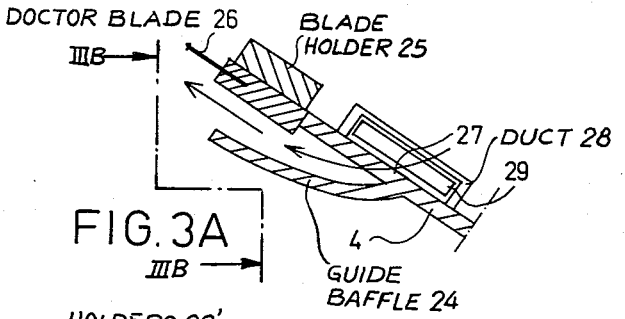
FIG. 3A is a sectional view, on an enlarged scale, of the embodiment of the air-blowing member of FIG. 3.
Figure 3B:
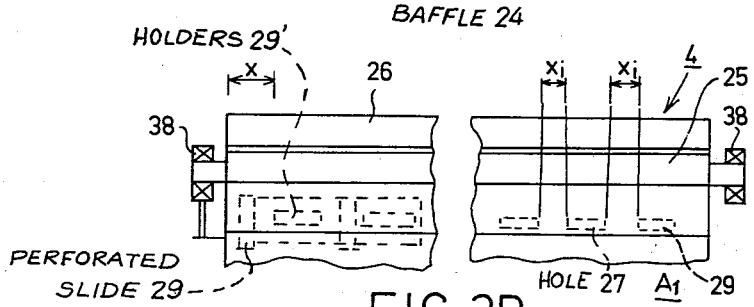
FIG. 3B is a bottom view, on an enlarged scale, of the embodiment of FIG. 3A, taken along the lines III-B—IIIB, of FIG. 3A.

FIGS. 3, 3A and 3B show the blowing of air in the direction $F_2$ towards the cleft 13. The most critical region is in the cleft 13 immediately after the felt 3 and web W separate from the cylinder 1. It has been found in trial machine experiments carried out by the inventor that the optimum direction of the blowing of air in the direction $F_1$ is that which causes the main direction of the jet to strike the cylinder 1 immediately before the point where the web W separates from said cylinder.

FIG. 3A shows details of the air-blowing member 4 of FIG. 3 and illustrates a first way of guiding the air flow in the aforedescribed manner.

FIG. 3B is a bottom view of the embodiment of FIG. 3A. The air-blowing member 4 of FIG. 3B may be referred to as a doctor or blowing doctor while simultaneously serving as a doctor beam. The member 4 of FIG. 3B includes a doctor blade 26, apertures or holes 27 formed through said member for blowing out air, a guide baffle 24, a blade holder 25, and, in the marginal areas, a control mechanism for adjustment of the flow of air through the outflow holes or apertures. The control mechanism of FIG. 3B, which is not indispensable, is shown as a slide mechanism, with a perforated slide 29 and holders 29'. The control system may be provided on one or both margins of the doctor 4. The same function may also be accomplished by increasing the distance x of the first outflow aperture from the edge of the web W, and/or by escalating the aperture spacing x' so that it is wider on the margins, and/or by restricting the flow of air through the apertures closest to the edge.

In FIG. 3B, a pipe or duct 28 directs air into the air-blowing member or doctor 4. The foregoing applies to the breadth direction of the flow direction $F_1$, but the flow is directed into the cleft 14 by the effect of the state of motion of the surroundings, which are the cylinder 2 and the web W, provided that it is initially blown obliquely along with the direction of travel of said web.

FIG. 3B is a slide mechanism, in which there is a perforated slide 29 in holders. The control of air quantity is carried out by moving the slide 29 in longitudinal direction and, for example, in the axial direction of the cylinder 1, so that the area of the parts of the holes 27 and 29 through which air may flow, and which are in alignment or partial alignment with each other, may be controlled. When the holes 27 and 29 are located exactly in alignment with each other, restriction is smallest and air quantity is greatest. On the other hand, the slide 29 may be moved to such a position that the hole 27 and the slide holes have no common area, whereby the control device is in a fully-closed position.

Figure 4:
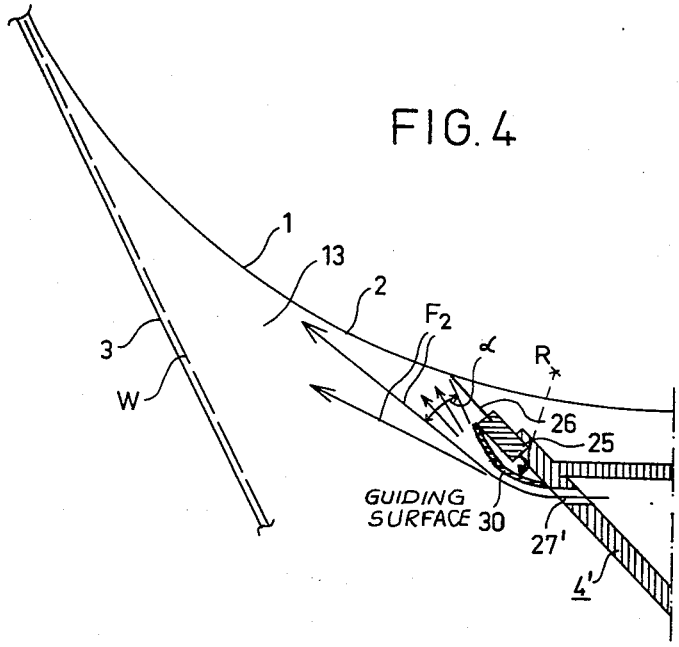
FIG. 4 is a sectional view, on a greatly enlarged scale, of part of a second embodiment of the air-blowing member of the device of the invention.
Figure 4A:
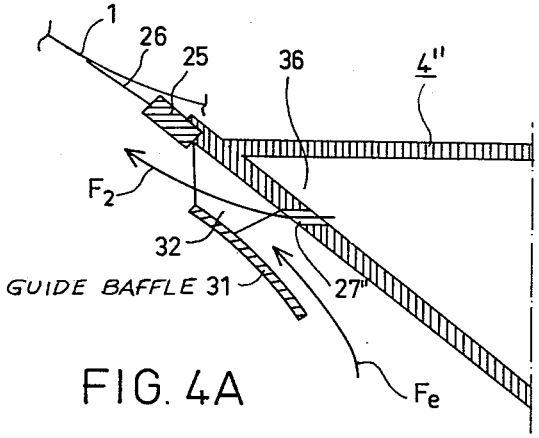
FIG. 4A is a sectional view, on a greatly enlarged scale, of part of a third embodiment of the air-blowing member of the device of the invention.

FIGS. 4 and 4A show second and third embodiments of the air-blowing member or doctor 4' and 4'', respectively. The embodiments of FIGS. 4 and 4A blow air in the direction $F_2$ to direct it into the cleft 13. The embodiment of FIG. 4 is based on the principle that an air flow blown along a surface 30 follows said surface due to the Coanda effect, if the angle subtended by the blowing action with said surface and the curvature and blowing velocity have an appropriate ratio. In directing the air flow, as shown in FIG. 4, it must be taken into consideration that the blown air jet $F_2$ fans out. There thus remains between the trailing part of the guiding surface and the desired jet an angle $\alpha \approx 5°$ to $15°$. This must be taken into account when determining the shape of the directing or guiding surface 30.

In the embodiment of FIG. 4A, a guide baffle 31 directs the air flow $F_2$. The baffle 31 deflects the air flow in the desired direction $F_2$ and ejects an air flow $F_e$ along with itself, in a space 32, with particular efficiency.

Figure 5:
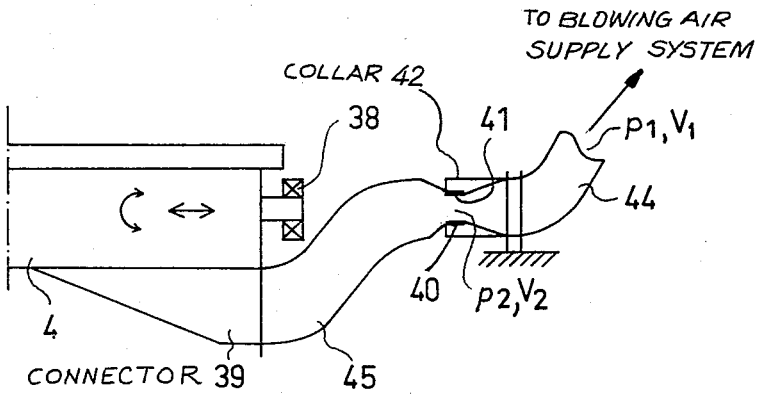
FIG. 5 is a schematic diagram, on an enlarged scale, of an embodiment of a connecting device connecting the doctor to the air-directing device of the invention.

FIG. 5 shows additional components of the air-directing device of the invention for supplying air to the air-blowing member or doctor 4 or 4' of the invention. Since the doctor 4 or 4' normally oscillates axially and it should be possible to lift off its blade 26 by turning the doctor beam about its longitudinal axis, the air-directing device of the invention must be so arranged that these operations are feasible.

The pipe required to conduct the requisite air quantities must have a diameter so large that it is doubtful whether a flexible junction or bellows can be provided which provides continuous satisfactory service under the conditions present in the machine hood. This problem may be circumvented by the system shown in FIG. 5. In FIG. 5, a pipe or tube 44 is connected to the blowing air supply system or network (not shown in the Figs.) and is fixedly mounted on the machine frame. Another pipe or tube 45 is integrally mounted in conjunction with a connector 39 of the doctor 4. The tube 45 is able to swivel around the bearings 38 of the doctor 4, which bearings are designed to also permit the axial movement of said doctor.

The tube 45 has a reduced diameter socket 40 which fits over a reduced diameter socket 41 of the pipe 44. The pipe 44 also has a collar 42 which fits over the reduced diameter socket 40 of the tube 45. The reduced diameter sockets 40 and 41 and the collar 42 are round and are installed so that the socket 40 will in no position touch the socket 41 of said collar. Instead, there is a radial clearance between the sockets 40 and 41. The clearance is preferably about 1 to 5 mm. Leakage through the radial gap between the sockets 40 and 41 is prevented by the special design of the structural component and by so dimensioning the diameters that $P_2 = P_o$ = atmospheric pressure. The meaning of the pressure notations $P_1$ and $P_2$ is clearly indicated in FIG. 5.

If the collar 42 is positioned coaxially with the bearings 38 in the device of FIG. 5, a standardly constructed doctor may be used, and such doctor may be lifted off, and oscillated, in a normal manner.

Figure 6:
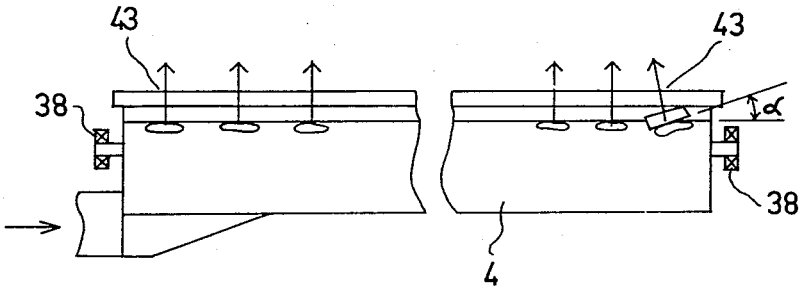
FIG. 6 is a schematic diagram, on an enlarged scale, of an embodiment of the air-blowing member of the air-directing device of the invention, showing air-blowing directions in marginal areas of the doctor blade and web.

FIG. 6 shows an embodiment of the air-blowing member or doctor of the invention which functions to boost the effect of over-pressure in a pocket P of a multiple cylinder dryer. The device of FIG. 6 accomplishes this by turning inward the air blowing directions 43 closest to the edge by turning the corresponding apertures closest to the edge. This results in a corresponding fraction of the pulse effect of the air flow creating an inwardly directed force, which prevents over-pressure produced by air blown in other directions from discharging through the ends of the pocket P. This expedient may be implemented by turning the air-blowing members of FIGS. 3A and 4 inward at a suitable angle.

The invention is by no means restricted to the aforementioned details which are described only as examples; they may vary within the framework of the invention, as defined in the following claims.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. An air-directing device for a multiple cylinder dryer of a paper machine, said multiple cylinder dryer having a plurality of cylinders and a paper web passing over the cylinders, said device comprising air-supplying means for supplying and directing air to said multiple cylinder dryer, said air-supplying means including air-blowing members for blowing air, said air-supplying means being so placed and said air-blowing members being so disposed and directed that the air blown out from said members is directed into the clefts defined by the surface of the drying cylinder and the paper web thereby producing a pressure effect in said clefts, each of said air-blowing members comprising a doctor having a doctor beam for conducting and directing air, said doctor beam having a surface, air-blowing apertures formed through said surface and a Coanda guide baffle having a leading edge affixed to said surface of said doctor beam next-adjacent said apertures and a spaced opposite trailing edge affixed to said surface in spaced relation with said apertures in a manner whereby said Coanda guide baffle is free from said apertures but directs air from said apertures into said clefts.

2. An air-directing device as claimed in claim 1, wherein a tangent to the trailing edge of said Coanda guide baffle is at a small angle of 5° to 15° with a tangent to the corresponding cylinder coincident with the direction of air flowing from said trailing edge into a cleft.

* * * * *